US005562040A

United States Patent [19]

Egli

[11] Patent Number: 5,562,040

[45] Date of Patent: Oct. 8, 1996

[54] ROPE GUIDE SYSTEM FOR AN AERIAL ROPEWAY, PARTICULARLY A CIRCUITAL AERIAL ROPEWAY

[75] Inventor: Ernst Egli, Hittnau, Switzerland

[73] Assignee: Garaventa Holding AG, Goldau, Switzerland

[21] Appl. No.: 400,821

[22] Filed: Mar. 8, 1995

[30] Foreign Application Priority Data

Mar. 11, 1994 [CH] Switzerland ..... 726/94

[51] Int. Cl.[6] ..... B61B 7/04

[52] U.S. Cl. ..... 104/173.1; 104/178; 104/179; 104/180

[58] Field of Search ..... 104/94, 95, 96, 104/173.1, 178, 179, 180, 197, 35, 38, 99

[56] References Cited

U.S. PATENT DOCUMENTS

| | | | |
|---|---|---|---|
| 3,789,280 | 1/1974 | Oldfield | 318/45 |
| 3,866,537 | 2/1975 | Minkwitz | 104/99 |
| 4,509,430 | 4/1985 | Creissels | 104/180 |
| 4,619,206 | 10/1986 | Creissels | 104/178 |
| 4,848,241 | 7/1989 | Kunczynski | 104/173.1 |
| 4,958,574 | 9/1990 | Meindl | 104/178 |
| 5,060,576 | 10/1991 | Creissels | 104/178 |
| 5,127,336 | 7/1992 | Wakabayashi | 104/35 |

FOREIGN PATENT DOCUMENTS

| | | |
|---|---|---|
| 0226838 | 7/1987 | European Pat. Off. . |
| 0399919 | 11/1990 | European Pat. Off. . |
| 920114 | 3/1963 | United Kingdom . |
| 1370181 | 10/1974 | United Kingdom . |

*Primary Examiner*—S. Joseph Morano

*Attorney, Agent, or Firm*—Sughrue, Mion, Zinn, Macpeak & Seas

[57] ABSTRACT

A rope guide system and for an aerial ropeway includes a haulage rope that travels along a path between two stations, and comprises two driving wheels $4_1$, $4_2$ disposed at one of the stations and laterally offset with respect to each other, which convey the haulage rope. Two inner deflector wheels $6_1$, $6_2$ direct the rope to cross over itself at a predetermined location to form inner and outer rope loops, and cooperate to direct the inner rope loop toward and away from the two driving wheels. A first reversing wheel $5_1$ is disposed at the other station, and the inner rope loop passes around it. Either two additional reversing wheels $5_2$, $5_3$ or a second, larger reversing wheel $5_2$, about which the outer loop passes, is/are disposed at the other station. Two outer deflector wheels direct the outer rope loop toward and away from either the two additional reversing wheels or the second reversing wheel.

19 Claims, 5 Drawing Sheets

ROPE GUIDE SYSTEM FOR AN AERIAL ROPEWAY, PARTICULARLY A CIRCUITAL AERIAL ROPEWAY

BACKGROUND OF THE INVENTION

1. Field of the Invention

The invention relates to a rope guide system for an aerial ropeway, particularly a circuital aerial ropeway, comprising a haulage rope, configured to form two haulage rope loops which, in the region of the haulage path, are guided parallely side by side at the same height to form an ascending lane and a descending lane for moving vehicles coupled to the lanes.

2. Description of the Related Art

A conventional aerial ropeway system having improved stability against crosswinds or other unstable conditions includes a rope guide system having two haulage ropes. In the region of the haulage path, the two ropes are guided parallely, side by side at the same height to form ascending and descending lanes whose widths correspond approximately to that of the vehicles coupled to the ropes.

For example, a conventional rope guide system, known as a QMC system (Quad Mono Cable system), has four individual, endless haulage ropes, each of which forms a rope loop. Each rope loop is reversed at the valley station and at the mountain station by a respective reversing wheel. All of the reversing wheels have an axis of rotation mounted approximately horizontal. A traction strand, to which the vehicles are coupled on both sides for ascending and descending, are formed on each pair of ropes by respective synchronous rope regions. The return strand of each rope loop is secured in order to form equal tensile forces in the four haulage ropes.

The four reversing wheels of a station are driven in opposite directions in pairs by a reversing gear unit, such as that described in the U.S. periodical "Ski Area Management", May 1988, pp 102–103 and 129 The four reversing wheels may also be driven in the same direction and be synchronized by a control device to run in paired synchronism. The haulage ropes can be crossed by respective deflector wheels to form two pairs of rope loops running in opposite directions (see, EP 285 516 A2). For emergency operation, the diameters of the rope pulleys on the drive wheels can be mechanically equalized.

The system described in European Patent Application EP 93 680 B1 includes two individual, endless haulage ropes, each of which forms a rope loop. To form the inner and outer rope loops which rotate in the same direction, the reversing wheels at the valley and mountain stations may be laterally offset in relation to One another (see FIGS. 16 and 17 of EP 93 680 B1) or may be arranged coaxially (see FIG. 15 of EP 93 680 B1). The haulage ropes guided parallely side by side at the same height in the region of the haulage path are directed to form the ascending and descending lanes of the same lane width for the coupled vehicles. The two driven reversing wheels have drives independent of one another, and are synchronized to the same rope haulage speed.

European Patent Application EP 399 919 B1 describes a rope guide system having two individual haulage ropes, each of which is endless, to form the inner and outer rope loops. Two driven reversing wheels, offset laterally in relation to one another, are provided at the driving station. The reversing station includes two traction-driven reversing wheels, offset laterally in relation to one another. Four deflector wheels, at each of the two stations, direct the four haulage ropes, guided parallely side by side at the same height in the region of the haulage path, to and away from the reversing wheels in different height positions in planes which are at an angle to the coupling points.

In this known rope guide system, two rope loops each having two synchronous regions for the ascending and descending lanes respectively are formed by crossing the two haulage ropes at both the driving station and at the reversing station. Hence, the two deflector wheels of the inner rope loop at each of the two stations are inclined, in order to change the running grooves on the reversing wheels while forming the rope crossing point. The two driven reversing wheels have drives which are independent of each other and are synchronized to achieve the same rope haulage speed in the two rope loops.

The rope guide systems described above, which have two or four individual, endless haulage ropes forming the inner and outer rope loops, is fairly expensive. Each individual haulage rope must be secured separately to obtain equal tensile forces in the individual pairs of ropes of each rope loop. Also, the pairs of ropes of different rope loops must be monitored for identical tensile forces and, if necessary, adjusted accordingly (see, for example, FIGS. 16 and 17 of EP 93 680 B1). To synchronize the rope haulage speed in the two rope loops, it is necessary to have a control device to which the rope haulage speed measured in each rope loop is fed as input signals, whereupon said device equalizes the speed of rotation of the respective drive motor.

A rope guide system having the generic features initially mentioned above is described in DE 37 12 941 C2. The two rope loops are formed from a single endless haulage rope crossed once to form inner and outer rope loops running in the same direction. Both the mountain and valley stations include a pair of coaxially mounted reversing wheels, by which the haulage ropes in the region of the haulage path are guided parallel side by side at the same height. The two rope loops are deflected so as to be offset in height in planes at an angle to the coupling stations.

The haulage ropes of the inner rope loop can run directly into the running grooves in the reversing wheels. However, the rope regions of the outer rope loop must be deflected in a lateral direction out of their position in which they lie one above the other in the reversing region, so as to form two synchronous lanes between the inner and outer rope loops. To accomplish this, four additional deflector wheels are necessary, one in on each of the inlet and outlet sides on each reversing wheel.

In addition, according to DE 37 12 941 C2, the two driven reversing wheels are coupled directly for conjoint rotation, or are replaced by a single rope pulley having two running grooves thus requiring only one drive for the two rope loops. Since the operative diameters at the two running grooves of the driving wheel differ from one another because of manufacturing tolerances and the like, and also due to wear and tear, the operative diameters on the driving wheels are never exactly equal. Hence, the rope haulage speeds differ slightly from one another in the two rope loops. Because of this, increased friction and thus increased wear occur on the driving wheel and may lead to the formation of frictional oscillations which are accompanied by undesirable noise and are transmitted through the haulage rope to the vehicles.

SUMMARY OF THE INVENTION

An object of the present invention is to simplify the rope guide system in a double haulage aerial ropeway which has a single haulage rope crossed once to form two rope loops and further, to ensure exactly identical rope haulage speeds in the two rope loops.

According to the present invention, this object is achieved by positioning the two driving wheels so that they are laterally offset from one another. Also, the two inner deflector wheels at the driving station are inclined in order to form the rope crossing point and to change the running grooves in the driving wheels. The first of traction-driven reversing wheels and the two inclined deflector wheels support the inner rope loop.

The outer rope loop is supported by two additional traction-driven reversing wheels, which are laterally offset relative to one another and arranged symmetrically to the first traction-driven reversing wheel. Alternatively, the outer rope loop is supported by a correspondingly large second traction-driven reversing wheel, arranged symmetrically to the first traction-driven reversing wheel, and the two driving wheels. The two driving wheels are driven independently of one another by a master machine and by a slave machine, and are synchronized to convey the two rope loops at the same haulage speed.

Because of the lateral offset of the two driving wheels, in conjunction with the lateral offset of the two traction-driven reversing wheels or with the single, correspondingly larger reversing wheel, with the rope guide system of the invention, the ascending or descending haulage rope of the outer rope loop can run directly into and out of the corresponding running groove in the respective reversing wheel. The inner rope loop is formed by the first traction-driven reversing wheel, which is symmetrically arranged centrally, and by the two inclined deflector wheels, which cross the haulage ropes once in planes offset relative to one another and change the running grooves in the driving wheels.

The invention thus includes four less deflector wheels than the rope guide system described in DE 37 12 941 C2. Moreover, only two deflector wheels of the inner rope loop which are associated with the driving wheels need be inclined in order to cross the haulage rope and to change the running grooves in the driving wheels.

Also, in the system of the present invention, exact synchronism of the haulage ropes in the two rope loops is ensured by synchronizing the two reversing wheels, which are driven independently of one another. Hence, control is much simpler than in the known rope guide systems having two individual haulage ropes (see EP 93 680 B1) or four individual haulage ropes (see EP 285 516 A2).

In addition, in the system of the present invention, the two driving motors can be operated as master and slave machines on the master and slave principle. The armature current of the master machine is measured and fed as input signal to a comparatively simple control device, which matches the armature current of the slave machine to that of the master machine. Measurement of the rope haulage speed and direct measurement and monitoring of equal pairs of tensile forces in the haulage ropes of the two rope loops are not necessary. Rather, in the system of the present invention, the conjoint securing of all the reversing wheels at the reversing station results in all four haulage ropes always having the same tensile force, which leads to uniform conditions in the drive.

Further, in the system of the present invention, the two reduction gear units of the master and slave machines are advantageously connected together by a differential gear unit, preferably a planetary differential gear unit. The freely rotatable part of the differential gear unit may be of drivable design in order to correct the different driving wheel diameters so as to achieve synchronism of the haulage ropes.

During braking, the two driving wheels are brought to rest by friction brakes. At the same time, the freely rotatable part of the differential gear unit is braked by a locking brake until the haulage ropes come to rest and are held locked so that the master drive is coupled for rotation with the slave drive and thus positively connected thereto. As a result, the two driving wheels are coupled to rotate together when braking occurs, and thus can be conjointly braked to a state of rest irrespective of the instantaneous coefficient of friction in the friction pairings of the two friction brakes. Hence, exact mechanical equalization of the rope pulley diameters when braking occurs is not necessary.

In emergency operation, that is, in the event of any failure in the drive units, the passengers situated in the haulage path must still be brought at a comparatively low speed of travel to the stopping stations. For this purpose, a hydraulic auxiliary drive is provided.

Toothed rims are provided on the two driving wheels, to which pinions driven by respective hydraulic motors can be coupled. A control device monitors an auxiliary driving machine to ensure exact synchronism of the haulage ropes.

The driving station may be the mountain station or the valley station. The reversing station is the other station. The driving wheels, together with the appertaining driving motors and reduction gear units, can be secured. The traction-driven reversing wheels are preferably secured.

On an aerial ropeway provided with the rope guide system according to the invention, two vehicles can run on the haulage path as a shuttle service. In order to form a circuital aerial ropeway, the vehicles are uncoupled from the two haulage ropes of the ascending and descending lanes at the stopping stations, and are run on station rails to the respective other lane at a low speed at which the passengers can conveniently leave or board the vehicles.

With the rope guide system according to the present invention, the reversals of the haulage rope, which is crossed once to form two rope loops, take place in planes which are at an angle to the coupling points at the stopping stations. Hence, it is possible to provide, at the mountain station and at the valley station, stabling sidings between the ascending lane and the descending lane to enable the vehicles uncoupled from the haulage rope to be parked with the aid of a turntable inserted into the station rails of the circuital aerial ropeway. The number of vehicles in circulation can thus in a simple manner be adapted to the instantaneous transport capacity requirement of the circuital aerial ropeway. The length of the stabling sidings can be fixed to permit the garaging of all the vehicles of the circuital aerial ropeway, taking into account the parking capacity of the station rails.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figures 1A, 1B:
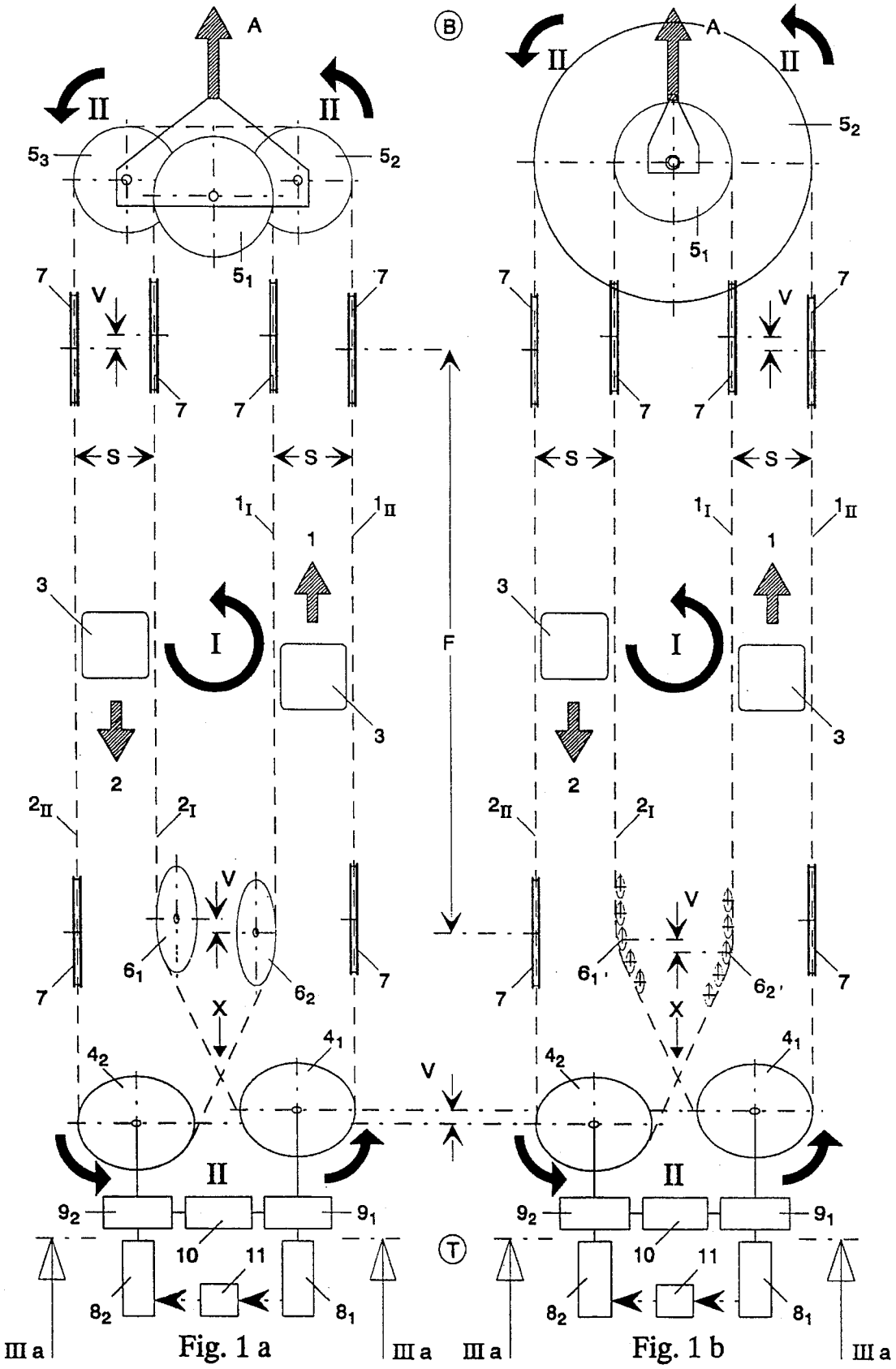
FIG. 1*a* shows a first embodiment of the rope guide system according to the present invention.
FIG. 1*b* illustrates a modification to the embodiment of the present invention shown in FIG. 1*a;*

FIG. 1*a* is a diagrammatic representation of the rope guide system of the present invention. The valley station T of the rope guide system is the driving station. Two driving wheels $4_1$ and $4_2$ are arranged side by side and laterally offset in the rope haulage direction. The driving wheels $4_1$ and $4_2$ are driven in the same direction, independently of one another, by separate electric driving motors $8_1$ and $8_2$, respectively, or the like, with the aid of reduction gear units $9_1$ and $9_2$, respectively.

At the mountain station B, which is the reversing station, three traction-driven reversing wheels $5_1$, $5_2$ and $5_3$ are mounted for rotation side by side and laterally offset in the rope haulage direction. Their mountings are conjointly secured by weights (not shown) at location "A". Alternatively, a hydraulic mounting system can be used.

The driving wheels $4_1$ and $4_2$, together with the reversing wheels $5_1$, $5_2$ and $5_3$, support a single endless haulage rope, which is crossed once in order to form two rope loops I and II. To change the running grooves in the driving wheels $4_1$ and $4_2$, the haulage rope is directed to cross by inclined deflector wheels $6_1$ and $6_2$. The rope crossing point, which is situated centrally in the plan view, is designated "X". From the rope crossing point X to the mountain station B, the inner rope loop I runs in the same direction as the outer rope loop II.

The inner rope loop I is supported by the central reversing wheel $5_1$ at the mountain station B, and by the two inclined deflector wheels $6_1$ and $6_2$, which direct the crossed haulage rope in offset planes to the running groove situated at a higher level on the one driving wheel $4_1$, and direct it away from the running groove situated at a lower level on the other driving wheel $4_2$, respectively. The outer rope loop II is supported by the two reversing wheels $5_2$ and $5_3$, which are laterally offset relative to one another and arranged symmetrically relative to the first reversing wheel $5_1$, at the mountain station B. The outer rope loop II is further supported by the two driving wheels $4_1$ and $4_2$, which are correspondingly offset in the lateral direction at the valley station T.

The two reversals of the rope at the mountain station B and at the valley station T take place in a plane at an angle to the haulage lane F. For this purpose, additional deflector wheels 7 are mounted horizontally on the four haulage ropes at the mountain station B. At the valley station T, it is sufficient to have two additional deflector wheels 7, which are mounted on horizontal or substantially horizontal axes of rotation and which, in conjunction with the two inclined deflector wheels $6_1$ and $6_2$, angle the reversing region at the valley station T.

The first reversing wheel $5_1$, which reverses the inner rope loop I, is offset in height in relation to the two reversing wheels $5_2$ and $5_3$, which reverse the outer rope loop II. The two driving wheels $4_1$ and $4_2$, and their running grooves, are also offset in height V relative to one another. For this purpose, corresponding offsets in height V are provided in the haulage direction between the mountings of the respective associated deflector wheels at the beginning and end of the haulage path F.

The synchronous regions of the two rope loops I and II are guided parallel side by side at the same height within the haulage path F with spacing equal to the lane width S. Vehicles 3 are coupled to the rope loops I and II. The two upwardly guided haulage ropes of the inner and outer rope loops I and II, respectively, are designated $1_I$ and $1_{II}$ and form the ascending lane 1. Similarly, the descending lane II is formed by the downwardly guided rope parts $2_I$ and $2_{II}$ of the rope loops I and II, respectively.

The exact synchronism of the haulage rope is ensured by synchronization of the speed of rotation of the two driving wheels $4_1$ and $4_2$, which are driven independently of one another. The one driving motor $8_1$ is operated as the master machine, and the other driving motor $8_2$ as the slave machine, in accordance with the master and slave principle. The armature current of the master machine $8_1$ is measured and forms the input signal for a control device 11, which matches the armature current of the slave machine $8_2$ to that of the master machine $8_1$. The reduction gear unit $9_1$ of the master machine $8_1$ and the reduction gear unit $9_2$ of the slave machine $8_2$ are connected to one another via a differential gear unit 10.

In a variation of the embodiment of FIG. 1*a*, as shown in FIG. 1*b*, the two reversing wheels $5_2$ and $5_3$ are replaced by a large second reversing wheel $5_2$, which is arranged coaxially (or symmetrically) to the first traction-driven reversing wheel $5_1$, and the diameter of which defines the width of the outer rope loop II. Also, instead of the two inclined deflector wheels $6_1$ and $6_2$, respective sets of inclined deflector rollers $6_1$, and $6_2$, are provided. In other respects, the embodiment shown in FIG. 1*b* coincides with that of FIG. 1*a*.

Figure 2:
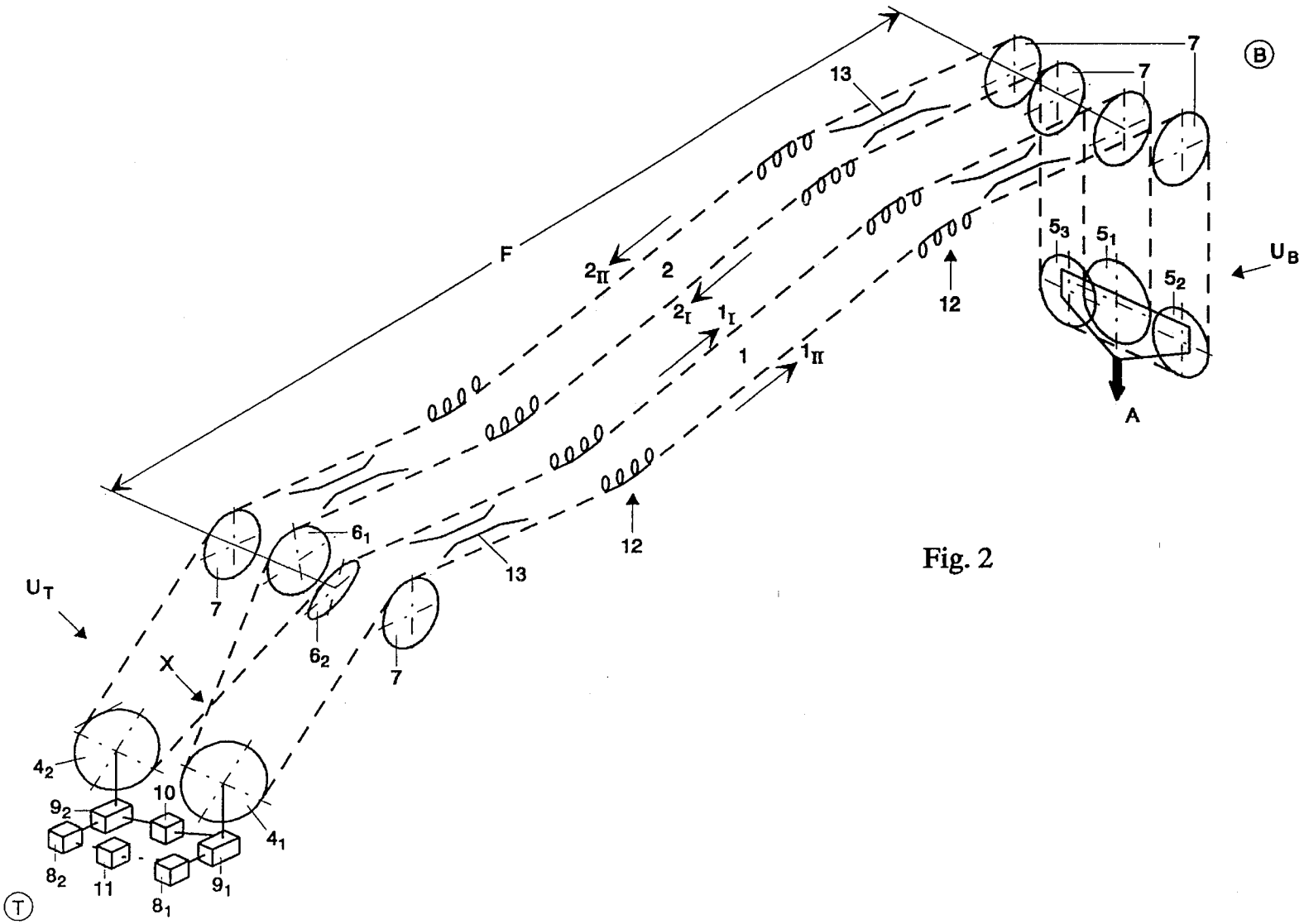
FIG. 2 shows a schematic view of the embodiment shown in FIG. 1*a;*

FIG. 2 is a perspective view of the embodiment according to FIG. 1*a*. In the region of the haulage path F, which is between the deflector wheels 6 and 7 at each stopping place B and T, the four synchronous haulage ropes $1_I$, $1_{II}$ and $2_I$, $2_{II}$, guided parallely side by side at the same height, are adapted by supporting rollers 12 on supports (not shown) to the conditions of the gradient. In order to form a circuital aerial ropeway, at the ends of the haulage path F, that is, at the mountain station B and valley station T, horizontally guided coupling positions 13 are provided.

The vehicles are detached from the haulage ropes at the coupling positions 13, and therefore run at low speed on station rails (not shown in FIG. 2) where the passengers board and depart. The vehicles are accelerated back to the rope haulage speed and suspended on the two haulage ropes after traveling around the station rails.

The four deflector wheels 6 and 7, provided at the mountain station B and valley station T, introduce through their offsets V the reversing regions $U_T$ and $U_B$, and set at an angle to the coupling points 13 at the valley station T and mountain station B, respectively. Hence, the two rope loops I and II are led to and away from the driving wheels $4_1$ and $4_2$, and from reversing wheels $5_1$, $5_2$ and $5_3$ at different or substantially different heights.

Six deflector wheels 7 are mounted with their axis of rotation being approximately horizontal, and the two central deflector wheels $6_1$ and $6_2$ at the driving station are inclined in order to change the running grooves in the driving wheels $4_1$ and $4_2$ by forming the rope crossing point X. The reversing region $U_T$ at the valley station T is offset obliquely in relation to the adjacent coupling point 12. The reversing wheels 5 in the reversing region $U_B$ at the mountain station B are secured vertically at A by weights or the like (not shown).

Figure 3A:
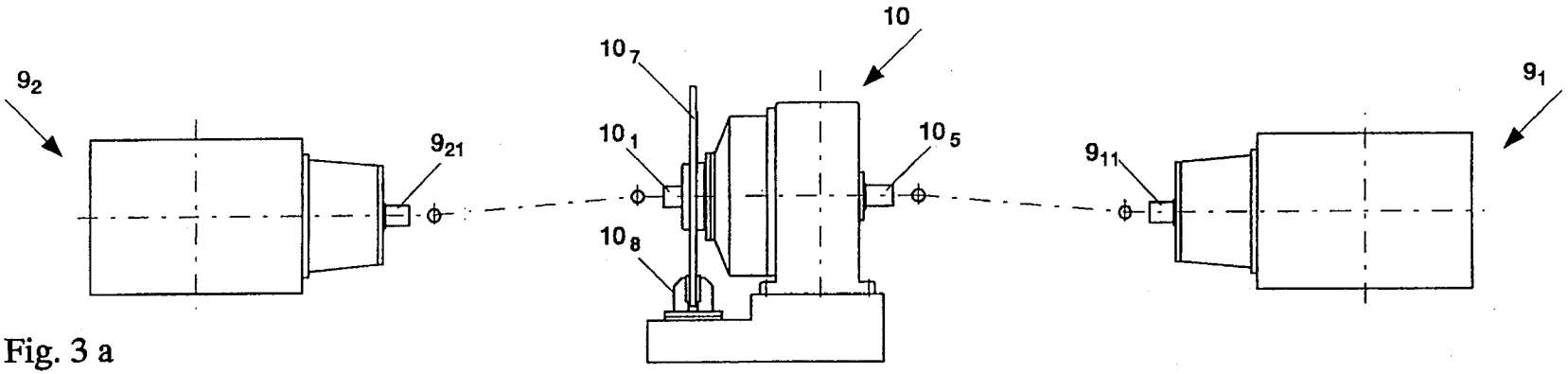
FIG. 3*a* shows a view taken along lines IIIa—IIIa in FIGS. 1*a* or 1*b* of the planetary differential gear unit connecting the two reduction gear units.

As shown in FIG. 3*a*, the two reduction gear units $\mathbf{9}_1$ and $\mathbf{9}_2$ have power take-off shafts $\mathbf{9}_{11}$ and $\mathbf{9}_{21}$, respectively. Each of the power take-off shaft $\mathbf{9}_{11}$ and $\mathbf{9}_{21}$ is connected by a cardan shaft to one of the two inputs $\mathbf{10}_1$ and $\mathbf{10}_5$, respectively, of the planetary differential gear unit 10. The planetary differential gear unit 10 has three coaxially rotatably mounted parts, namely, the central wheels $\mathbf{10}_1$ and $\mathbf{10}_5$, mounted on and rotating with its two input shafts, and a planet carrier $\mathbf{10}_6$ acting as a cage. Three planet wheels $\mathbf{10}_2$, $\mathbf{10}_3$ and $\mathbf{10}_4$, which mesh with one another or with the two central wheels $\mathbf{10}_1$ and $\mathbf{10}_5$, respectively, are rotatably mounted an the planet carrier $\mathbf{10}_6$. A brake disc $\mathbf{10}_7$ is connected for rotation with the planet carrier $\mathbf{10}_6$.

Figure 3C:
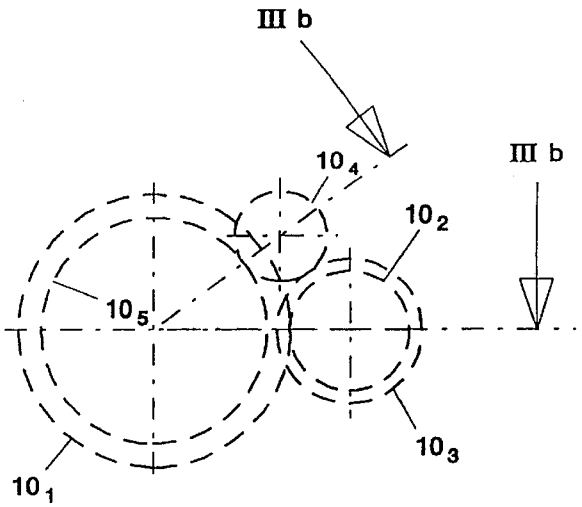
FIG. 3*c* shows the arrangement of the wheels of the planetary differential unit shown in FIG. 3*a;*
Figure 3B:
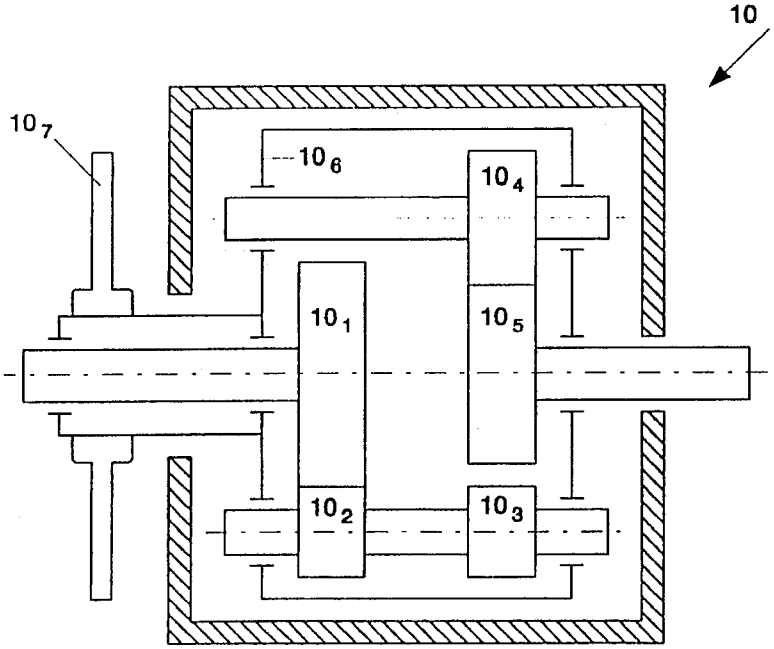
FIG. 3*b* is a cross-sectional view of the planetary gear arrangement taken along line IIIb—IIIb in FIG. 3*c;*

The engagement of the wheels $\mathbf{10}_1$ through $\mathbf{10}_5$ of the planetary differential 10 can be seen in detail in FIGS. 3*b* and 3*c*, wherein one central wheel $\mathbf{10}_1$ is shown as meshing with the planet wheel $\mathbf{10}_2$. The two planet wheels $\mathbf{10}_2$ and $\mathbf{10}_3$ are mounted on and rotate with the same shaft. The planet wheel $\mathbf{10}_3$ is in engagement with the planet wheel $\mathbf{10}_4$, which meshes with the other central wheel $\mathbf{10}_5$.

With exactly equal speeds of rotation on the two driving wheels $\mathbf{4}_1$ and $\mathbf{4}_2$ the planet carrier $\mathbf{10}_6$, together with the brake disc $\mathbf{10}_7$, is stationary. When there are slight deviations in speed of rotation on the two driving wheels $\mathbf{4}_1$ and $\mathbf{4}_2$, the planet carrier starts to rotate in one direction or the other. In accordance with FIG. 3*a*, a brake application device $\mathbf{10}_8$, fastened to the frame, is arranged on the brake disc $\mathbf{10}_7$, rotating with the planet carrier $\mathbf{10}_6$, of the planetary differential 10.

If braking occurs, the two driving wheels $\mathbf{4}_1$ and $\mathbf{4}_2$ are braked by friction brakes (not shown) until they come to rest. At the same time, the locking brake $\mathbf{10}_7$–$\mathbf{10}_8$, which holds fast the planet carrier $\mathbf{10}_6$ as a cage of the planetary differential 10, is operated, so that the two driving wheels $\mathbf{4}_1$ and $\mathbf{4}_2$ are connected for rotation with one another at the same speed, irrespective of the instantaneous coefficient of friction at the friction pairings of the two friction brakes. The four haulage ropes $\mathbf{1}_I$, $\mathbf{1}_{II}$, and $\mathbf{2}_I$, $\mathbf{2}_{II}$, respectively, can thus be conjointly slowed down until they come to rest.

Figure 4:
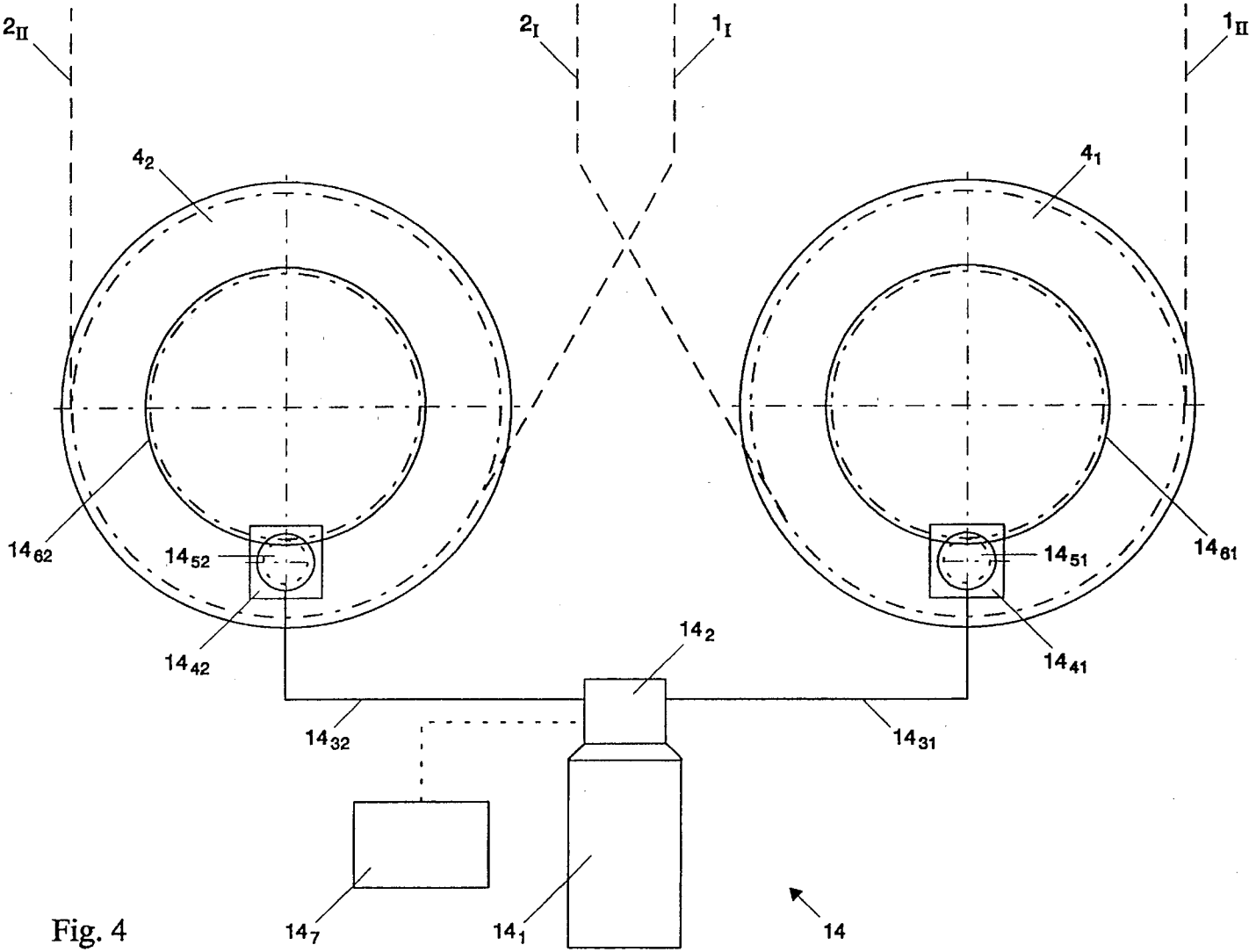
FIG. 4 shows an embodiment of the hydraulic auxiliary drive for emergency operation as in the present invention.

For emergency operation, for example, in the event of any failure in the two drive trains $\mathbf{8}_1$-$\mathbf{9}_1$-$\mathbf{4}_1$ and $\mathbf{8}_2$-$\mathbf{9}_2$-$\mathbf{4}_2$, respectively, the drive trains can be disconnected from the driving wheels $\mathbf{4}_1$ and $\mathbf{4}_2$. As shown in FIG. 4, a hydraulic auxiliary drive 14 is provided.

In the hydraulic auxiliary drive 14, a diesel engine $\mathbf{14}_1$ drives an oil pump $\mathbf{14}_2$, which is connected via hydraulic lines $\mathbf{14}_{31}$and $\mathbf{14}_{32}$, to two hydraulic motors $\mathbf{14}_{41}$ and $\mathbf{14}_{42}$, respectively. Toothed rims $\mathbf{14}_{61}$ and $\mathbf{14}_{62}$ are provided on driving wheels $\mathbf{14}_1$ and $\mathbf{14}_2$, respectively, with each of which a pinion $\mathbf{14}_{51}$ and $\mathbf{14}_{52}$, respectively, can be brought into and out of engagement. The pinions $\mathbf{14}_{51}$ and $\mathbf{14}_{52}$ are driven by the hydraulic motors $\mathbf{14}_{41}$ and $\mathbf{14}_{42}$, respectively, or the like.

A control device $\mathbf{14}_7$ ensures that the haulage ropes $\mathbf{1}_I$, $\mathbf{1}_{II}$ and $\mathbf{2}_I$, $\mathbf{2}_{II}$ are moved synchronously. Input signals for the control device $\mathbf{14}_7$ are supplied by a travel measurement device (not shown), which measures the travel of the ropes. One sensor roller on each rope can act as the travel measurement device. As an alternative, master and slave operation is also possible.

Figure 5:
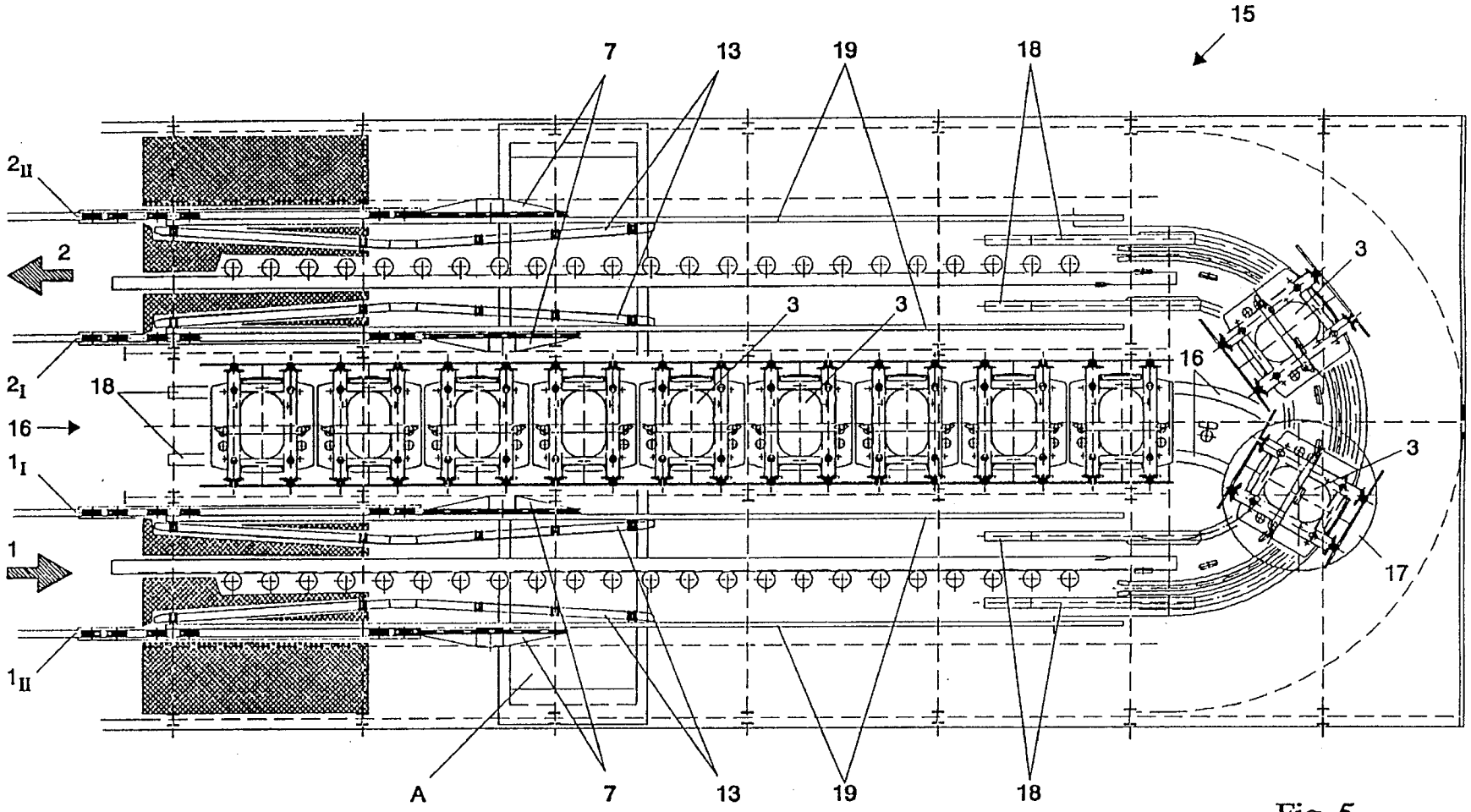
FIG. 5 shows an exemplary plan view of a station lane at a stopping station on a circuital aerial ropeway.

FIG. 5 shows a plan view of the station rail system 15 of the mountain station B of a circuital aerial ropeway. The vehicles 3, uncoupled from the two incoming haulage ropes $\mathbf{1}_I$ and $\mathbf{1}II$ of the ascending lane 1 at the coupling point 13, are brought to a slow speed in the region of running rails 19, and travel about a curve on a rail lane 18 to the descending lane 2, while passengers depart from and board the vehicles 3. On reaching the point at which the vehicles are to recouple with the haulage ropes, the vehicles are accelerated back to the rope haulage speed or approximately the rope haulage speed in the region of the running rails 19 on the descending lane 2. Hence, in the region of the coupling point 13, the vehicles are suspended on the two outgoing haulage ropes $\mathbf{2}_I$ and $\mathbf{2}_{II}$ of the descending lane 2.

In the free space between the ascending lane 1 and the descending lane 2, a side rail 16 is arranged and a turntable 17 is installed in the curved rail lane 18. The vehicle 3 situated on the turntable 17 can be directed to the side rail 16 through the turning of the turntable 17.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A rope guide system for an aerial ropeway, which system includes a haulage rope that travels over a haulage path region between at least two stations, comprising:

two driving wheels ($\mathbf{4}_1$, $\mathbf{4}_2$), disposed at one of the stations and laterally offset with respect to each other, which convey the haulage rope;

two inner deflector wheels ($\mathbf{6}_1$, $\mathbf{6}_2$) which direct the rope to cross over itself at a predetermined location to form inner and outer rope loops, and which cooperate to direct the inner rope loop toward and away from the two driving wheels;

a first reversing wheel ($\mathbf{5}_1$), disposed at the other of the stations, about which the inner rope loop passes;

further reversing means selected from one of:

two additional reversing wheels ($\mathbf{5}_2$, $\mathbf{5}_3$), disposed at the other station, about which the outer rope loop passes; and a second reversing wheel ($\mathbf{5}_2$) having a larger diameter than the first reversing wheel, disposed at the other station, about which the outer rope loop passes; and a driving apparatus which drives the two driving wheels so that the two rope loops are conveyed at the same or substantially the same haulage speed, wherein the two additional reversing wheels, when selected, are laterally offset with respect to one another and arranged symmetrically about the first reversing wheel, and the second reversing wheel, when selected, is disposed symmetrically with respect to the first reversing wheel.

2. A rope guide system as claimed in claim 1, wherein the two inner deflector wheels direct the inner loop so that the rope is directed to predetermined running grooves in the two driving wheels.

3. A rope guide system as claimed in claim 1, further comprising two outer deflector wheels (7) which cooperate to direct the outer rope loop toward and away from a selected one of the two additional reversing wheels, and the second reversing wheel.

4. A rope guide system as claimed in claim 3, wherein the inner and outer deflector wheels guide the inner and outer loops so that, in the haulage path region of the system, portions of the inner and outer loops travel parallel or substantially parallel to one another and at the same or substantially the same height, to form an ascending lane and a descending lane having equal or substantially equal widths, to convey vehicles coupled to the rope within the ascending or descending lanes; and wherein the driving, reversing, inner deflector and outer deflector wheels cooperate to form equal or substantially equal tensile forces in the inner and outer loops.

5. A rope guide system as claimed in claim 1, wherein the driving apparatus comprises a master machine and a slave machine which respectively drive the two driving wheels independently of one another, and are synchronized to convey the inner and outer rope loops at the same rope haulage speed.

6. A rope guide system as claimed in claim 5, wherein the master and slave machines comprise reduction gear units, and the system further comprises a differential gear unit which mechanically couples the reduction gear units of the master and slave machines to each other.

7. A rope guide system as claimed in claim 1, wherein:

the driving wheels each comprise toothed rims, and the driving apparatus is a hydraulic auxiliary drive apparatus comprising:

hydraulic motors which drive pinions, each of which engage a said toothed rim of a respective one of the driving wheels; and a control device which controls the hydraulic motors to control driving of the driving wheels to maintain synchronization of movement of the inner and outer loops.

8. A rope guide system as claimed in claim 1, wherein the inner and outer loops travel parallel or substantially parallel to one another and at the same or substantially the same height, to form an ascending lane and a descending lane having equal or substantially equal widths to convey vehicles coupled to the rope within the ascending or descending lanes; and wherein the system further comprises:

station rails, disposed in the stations, over which the vehicles, uncoupled from the rope, are conveyed through the stations;

a track, disposed between the ascending and descending lanes at at least one of the stations, onto which the vehicles, uncoupled from the rope, can be parked; and a turntable, disposed at the station rail of at least one of the stations, which directs the vehicles onto the track from the station rail and vice versa.

9. A rope guide system for an aerial ropeway, which system includes a haulage rope that travels over a haulage path region between at least two stations, comprising:

two driving wheels ($\mathbf{4}_1$, $\mathbf{4}_2$), disposed at one of the stations and laterally offset with respect to each other, which convey the haulage rope;

two inner deflector wheels ($\mathbf{6}_1$, $\mathbf{6}_2$) which direct the rope to cross over itself at a predetermined location to form inner and outer rope loops, and which cooperate to direct the inner rope loop toward and away from the two driving wheels;

a first reversing wheel ($\mathbf{5}_1$), disposed at the other of the stations, about which the inner rope loop passes;

further reversing means selected from one of:

two additional reversing wheels ($\mathbf{5}_2$, $\mathbf{5}_3$), disposed at the other station, about which the outer rope loop passes; and a second reversing wheel ($\mathbf{5}_2$) having a larger diameter than the first reversing wheel, disposed at the other station, about which the outer rope loop passes; and a driving apparatus which drives the two driving wheels so that the two rope loops are conveyed at the same or substantially the same haulage speed, wherein the driving apparatus comprises a master machine and a slave machine which respectively drive the two driving wheels independently of one another, and are synchronized to convey the inner and outer rope loops at the same rope haulage speed, and wherein the master and slave machines comprise reduction gear units, and the system further comprises a differential gear unit which mechanically couples the reduction gear units of the master and slave machines to each other.

10. A rope guide system as claimed in claim 9, further comprising a device which measures armature current of the master machine and provides signals indicative thereof, and a control device which, based on the signals, adjusts armature current of the slave machine to be equal or substantially equal to that of the master machine.

11. A rope guide system as claimed in claim 9, wherein the differential gear unit is a planetary differential gear unit.

12. A rope guide system as claimed in claim 9, wherein the differential gear unit includes a freely rotatable part which is drivable to compensate for differences between the diameters of the driving wheels to maintain synchronism in the movement of the rope loops.

13. A rope guide system as claimed in claim 12, further comprising a locking brake which brakes the freely rotatable part of the differential gear unit to cause the reduction gear unit of the master machine to rotate in synchronism with the reduction gear unit of the slave machine.

14. A method for conveying a haulage rope of a rope guide system for an aerial ropeway having a haulage path region between at least two stations, comprising the steps of:

directing the rope to cross over itself at a predetermined location to form inner and outer rope loops, and directing the inner rope loop toward and away from two driving wheels ($\mathbf{4}_1$, $\mathbf{4}_2$) disposed at one of the stations;

directing the inner rope loop about a first reversing wheel ($\mathbf{5}_1$) disposed at the other of the stations;

performing a selected one of the following steps:

directing the outer loop about two additional reversing wheels ($\mathbf{5}_2$, $\mathbf{5}_3$) disposed at the other station; and directing the outer loop about a second reversing wheel ($\mathbf{5}_2$) having a larger diameter than the first reversing wheel disposed at the other station; and driving the two driving wheels to convey the two rope loops at the same or substantially the same haulage speed over the haulage path region, wherein, when selected, laterally offsetting the two additional reversing wheels with respect to one another and arranging them symmetrically about the first reversing wheel, and, when selected, disposing the second reversing wheel symmetrically with respect to the first reversing wheel.

15. A method as claimed in claim 14, further comprising the step of guiding the inner and outer loops so that, in the haulage path region of the system, portions of the inner and outer loops travel parallel or substantially parallel to one another and at the same or substantially the same height, to form an ascending lane and a descending lane having equal or substantially equal widths, to convey vehicles coupled to the rope within the ascending or descending lanes; and maintaining equal or substantially equal tensile forces in the inner and outer loops.

16. A method as claimed in claim 14, wherein the driving step drives the two driving wheels independently of one another and synchronously with one another to convey the inner and outer rope loops at the same or substantially the same rope haulage speed.

17. A method as claimed in claim 14, further comprising the steps of:

uncoupling a vehicle from the rope in at least one of the stations;

moving the uncoupled vehicle over a station rail in the at least one of the stations;

directing the uncoupled vehicle onto a track in the station from the station rail; and parking the uncoupled vehicle on the track.

18. A rope guide system for an aerial ropeway, which system includes a haulage rope that travels over a haulage path region between at least two stations, comprising:

two driving wheels ($\mathbf{4}_1$, $\mathbf{4}_2$), disposed at one of the stations and laterally offset with respect to each other, which convey the haulage rope;

two inner deflector wheels ($\mathbf{6}_1$, $\mathbf{6}_2$) which direct the rope to cross over itself at a predetermined location to form inner and outer rope loops, and which cooperate to direct the inner rope loop toward and away from the two driving wheels;

a first reversing wheel ($\mathbf{5}_1$), disposed at the other of the stations, about which the inner rope loop passes;

further reversing means selected from one of:

two additional reversing wheels ($\mathbf{5}_2$, $\mathbf{5}_3$), disposed at the other station, about which the outer rope loop passes; and a second reversing wheel ($\mathbf{5}_2$) having a larger diameter than the first reversing wheel, disposed at the other station, about which the outer rope loop passes; and a driving apparatus which drives the two driving wheels so that the two rope loops are conveyed at the same or substantially the same haulage speed, wherein the driving wheels each comprise toothed rims, and the driving apparatus is a hydraulic auxiliary drive apparatus comprising:

hydraulic motors which drive pinions, each of which engage a said toothed rim of a respective one of the driving wheels; and a control device which controls the hydraulic motors to control driving the driving wheels to maintain synchronization of movement of the inner and outer loops.

19. A rope guide system for an aerial ropeway, which system includes a haulage rope that travels over a haulage path region between at least two stations, comprising:

two driving wheels ($\mathbf{4}_1$, $\mathbf{4}_2$), disposed at one of the stations and laterally offset with respect to each other, which convey the haulage rope;

two inner deflector wheels ($\mathbf{6}_1$, $\mathbf{6}_2$) which direct the rope to cross over itself at a predetermined location to form inner and outer rope loops, and which cooperate to direct the inner rope loop toward and away from the two driving wheels;

a first reversing wheel ($\mathbf{5}_1$), disposed at the other of the stations, about which the inner rope loop passes;

further reversing means selected from one of:

two additional reversing wheels ($\mathbf{5}_2$, $\mathbf{5}_3$), disposed at the other station, about which the outer rope loop passes; and a second reversing wheel ($\mathbf{5}_2$) having a larger diameter than the first reversing wheel, disposed at the other station, about which the outer rope loop passes; and a driving apparatus which drives the two driving wheels so that the two rope loops are conveyed at the same or substantially the same haulage speed, wherein the inner and outer loops travel parallel or substantially parallel to one another and at the same or substantially the same height, to form an ascending lane and a descending lane having equal or substantially equal widths to convey vehicles coupled to the rope within the ascending or descending lanes; and wherein the system further comprises:

station rails, disposed in the stations, over which the vehicles, uncoupled from the rope, are conveyed through the stations;

a track, disposed between the ascending and descending lanes at at least one of the stations, onto which the vehicles, uncoupled from the rope, can be parked; and a turntable, disposed at the station rail of at least one of the stations, which directs the vehicles onto the track from the station rail and vice versa.

* * * * *